US009932694B2

(12) United States Patent
Weinhold et al.

(10) Patent No.: US 9,932,694 B2
(45) Date of Patent: Apr. 3, 2018

(54) ROLLER

(71) Applicant: Oerlikon Textile GmbH & Co. KG, Remscheid (DE)

(72) Inventors: Jens Weinhold, Chemnitz (DE); Joachim Lauckner, Chemnitz (DE); Bert Wöllner, Hohenstein-Emstthal (DE); Marco Sacher, Chemnitz (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 99 days.

(21) Appl. No.: 15/029,130

(22) PCT Filed: Oct. 13, 2014

(86) PCT No.: PCT/EP2014/071896

§ 371 (c)(1),
(2) Date: Apr. 13, 2016

(87) PCT Pub. No.: WO2015/055585

PCT Pub. Date: Apr. 23, 2015

(65) Prior Publication Data

US 2016/0251781 A1 Sep. 1, 2016

(30) Foreign Application Priority Data

Oct. 15, 2013 (DE) ..... 10 2013 017 053

(51) Int. Cl.
*D02J 1/22* (2006.01)
*D01D 10/04* (2006.01)
(Continued)

(52) U.S. Cl.
CPC ..... *D02J 1/225* (2013.01); *B65H 57/14* (2013.01); *B65H 75/185* (2013.01);
(Continued)

(58) Field of Classification Search
CPC . D02J 1/225; D02J 13/005; B65H 2404/1141; B65H 2404/1317; B65H 2404/13; B65H 2404/10; B65H 2404/11; B65H 2404/17; B65H 2404/19; B65H 57/14; B65H 75/185; B65H 75/187;
(Continued)

(56) References Cited

U.S. PATENT DOCUMENTS 1,545,897 A * 7/1925 Haynes ..... H04N 1/08 346/138
2,393,191 A * 1/1946 Robertson ..... D06C 3/067 100/162 B
(Continued)

FOREIGN PATENT DOCUMENTS

DE 3144977 A1 6/1982
EP 0349829 A2 1/1990
(Continued)

*Primary Examiner* — Amy Vanatta
(74) *Attorney, Agent, or Firm* — BainwoodHuang

(57) ABSTRACT

A roller guides and processes synthetic strand material. The roller includes a drivable roller shell. The roller shell has, on a projecting free end thereof, a cover which is effective relative to the surroundings. In order to secure the end of the roller shell relative to an operating side, the cover is freely rotatably connected to the roller shell.

12 Claims, 2 Drawing Sheets

Figure 1:
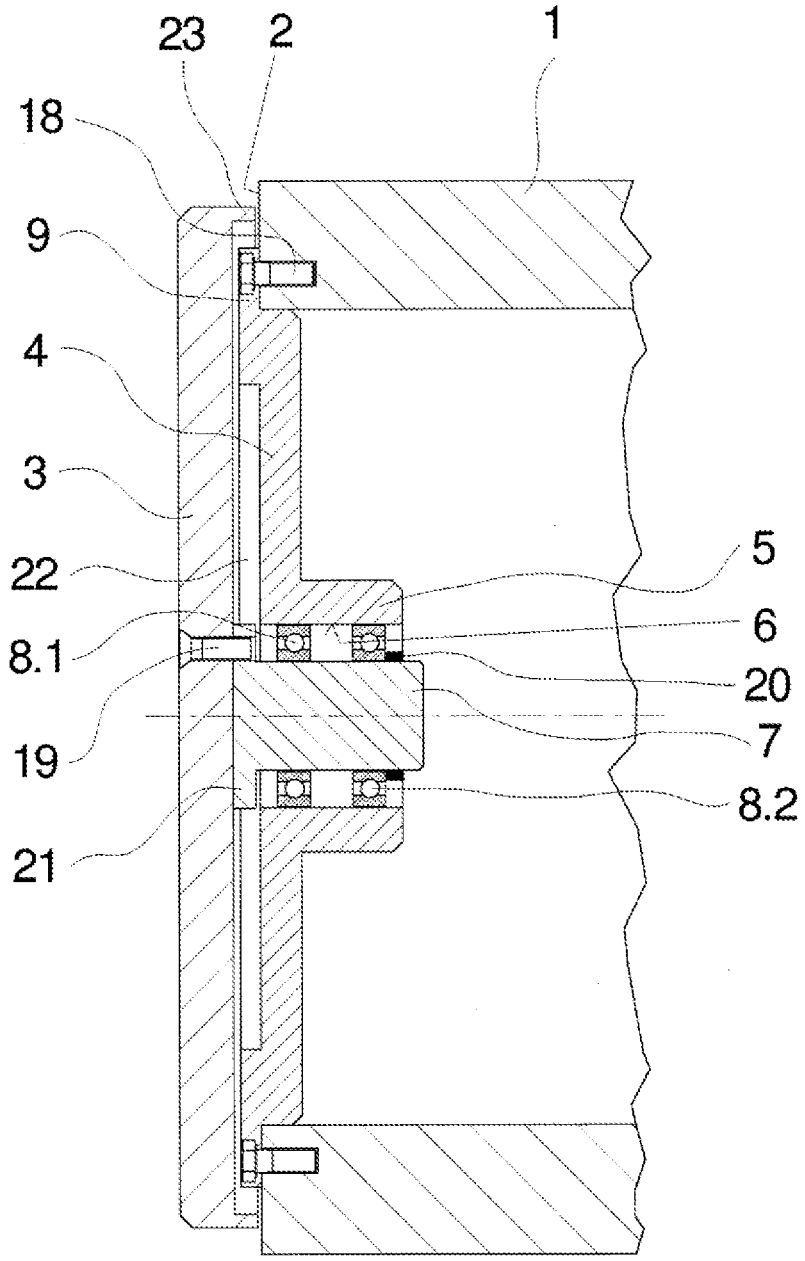

(51) Int. Cl.
*B65H 57/14* (2006.01)
*D02J 13/00* (2006.01)
*B65H 75/18* (2006.01)

(52) U.S. Cl.
CPC ..... *D01D 10/0436* (2013.01); *D02J 13/005* (2013.01); *B65H 2701/3132* (2013.01)

(58) Field of Classification Search
CPC ..... B02C 4/28; B02C 4/44; D01D 10/0436; D01D 10/0445
USPC ..... 26/97, 99, 98, 100, 102, 104; 492/38, 492/46, 47, 48; 28/245
See application file for complete search history.

(56) References Cited

U.S. PATENT DOCUMENTS 3,157,935 A * 11/1964 Birch ..... D06C 3/067 162/271
3,228,579 A * 1/1966 Dong ..... B65D 83/0841 225/23
3,753,517 A * 8/1973 Takenaka ..... B65H 51/06 226/194
4,194,275 A * 3/1980 Freuler ..... B65H 23/0251 26/100
4,862,565 A * 9/1989 Damour ..... D06C 3/06 26/99
5,398,585 A 3/1995 Starr
5,398,858 A 3/1995 Dugan et al.
5,435,038 A * 7/1995 Sauers ..... A47L 9/0455 15/179
5,476,437 A * 12/1995 Damour ..... B65G 39/02 492/47
6,053,298 A * 4/2000 Nimmo ..... B65G 39/12 193/37
6,830,212 B1 * 12/2004 Harris ..... B65H 23/038 226/23
9,677,211 B1 * 6/2017 Damour ..... D06C 3/06
2003/0136628 A1 * 7/2003 Dyson ..... B65G 39/09 193/37
2003/0183480 A1 * 10/2003 Dyson ..... B65G 39/09 193/37
2009/0018004 A1 * 1/2009 Verfaellie ..... D21G 1/0226 492/49
2012/0024658 A1 * 2/2012 Fox ..... B65G 39/09 193/37
2014/0165315 A1 * 6/2014 Taub ..... A47L 25/005 15/104.002

FOREIGN PATENT DOCUMENTS

FR 2681583 A1 3/1993
JP 2003096639 A 4/2003

* cited by examiner

ROLLER

The invention relates to a roller for guiding and treating synthetic strand materials as disclosed herein.

A roller of this type is known from DE 31 44 977 A1.

When producing synthetic strand materials, such as film tapes, monofilaments, films or fiber strands in an extrusion process, rollers are used in order to guide and treat the synthetic strand materials. Rollers of this type, which are also referred to in the specialist field as godets, are arranged at a roller support in a projecting manner and have a drivable roller shell, which is designed so as to be heatable from the inside for the thermal treatment of synthetic strand materials. Rollers of this type are usually used in multiple at a roller support in order for drawing-off the strand material from an extrusion installation or for orienting said strand material. Here, the drawing-off and orienting units are arranged adjacently along an operating aisle, wherein the projecting front ends of the roller shells face toward an operating side.

In the case of the known roller, the front end of the roller shell is closed by a cover, such that the interior of the roller shell is shielded against ambient influences. However, rollers of this type have the disadvantage that during operation the operating staff must take safety measures so as not to come into contact with the rotating ends of the rollers. The rollers are usually assigned additional shields for this purpose.

The object of the invention is to develop a roller of the type in question in such a way that additional shields of the front end are dispensable.

This object is achieved in accordance with the invention in that the cover is connected to the roller shell in a freely rotatable manner.

Advantageous developments of the invention are defined by the features and combinations of features as disclosed herein.

The invention is characterized in that the projecting front end of the roller shell does not experience any forced rotation by the drive of the roller shell. The cover of the roller, which cover can be contacted externally, is detached from the drive of the roller shell, such that an operator can contact the cover without any safety risk.

In order to obtain a decoupling between the cover and the drive of the roller shell and in order to ensure a reliable closure of the roller shell with respect to the surrounding environment, the development of the invention is preferably embodied such that at the front end a cover carrier is provided between the roller shell and the cover, which cover carrier is fixedly connected to the roller shell and rotatably holds the cover. In this respect, sufficient stability to close the roller shell can be realised.

In order to accommodate the cover, the cover carrier preferably has a central bearing bore, in which a bearing journal is rotatably held that is fixedly connected to the cover.

The bearing journal can be mounted here in the cover carrier advantageously by at least one rolling bearing or a plurality of rolling bearings, such that the cover can be held in a rest position without a relatively great holding force, even with high circumferential speeds of the roller shell. Instead of the rolling bearings, the bearing journal could also be mounted slidingly within the bearing bore by means of a slide bushing.

Since roller shells of this type are preferably also used for the thermal treatment of the synthetic strand material, the development of the invention is preferably embodied in such a way that the roller shell is assigned a heating means on the inside and the cover at the front end is assigned a thermal insulation on an inner side or outer side. The surface of the cover can thus be held, relative to the heated roller shell, at a temperature level that is not critical to operating staff, even in the event of contact.

In principle, however, it is also possible to form the cover in accordance with an advantageous development of the invention in two parts, wherein a thermal insulation is provided between an inner cover and an outer cover. Thermal insulation materials that are less stable, but highly effective can thus also be used for temperature decoupling.

In order to ensure the stability of the cover, the thermal insulation furthermore can be formed by a plurality of air chambers, wherein the air chambers are uniformly distributed within the cover.

The air chambers may thus be formed preferably by circumferential grooves on a front end face of the inner cover, wherein the grooved front end face of the inner cover can be braced against a closed front end face of the outer cover.

The insulating effect can be further improved in that the outer cover is additionally formed from a thermally insulating material.

The roller according to the invention thus provides a high level of safety in extrusion facilities for producing synthetic strand materials. The free front ends of the rollers can be contacted directly by an operator without additional protective measures.

The invention will be explained hereinafter in greater detail on the basis of a number of exemplary embodiments of the roller according to the invention, with reference to the accompanying figures.

Figure 2:
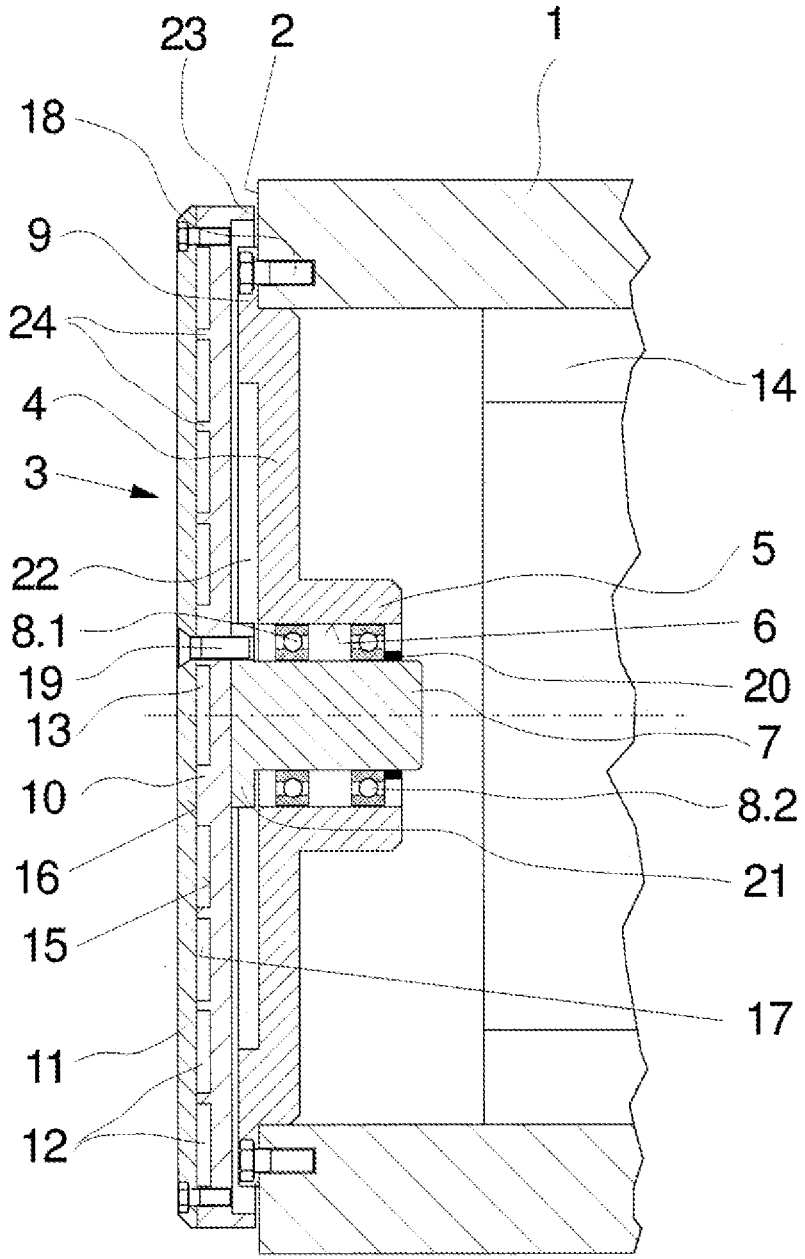

In the figures:

FIG. 1 schematically shows a cross-sectional view from one front end in accordance with a first exemplary embodiment of the roller according to the invention, FIG. 2 schematically shows a cross-sectional view from one front end in accordance with a further exemplary embodiment of the roller according to the invention.

In FIG. 1 a first exemplary embodiment of a roller according to the invention is illustrated, wherein only the parts of the roller essential to the invention are shown in a cross-sectional view. The roller has a drivable roller shell 1. The roller shell 1 is for this purpose mounted rotatably and in a projecting manner on a roller support (not illustrated here) and is coupled to a drive, for example an electric motor or a transmission. The roller shell 1 is hollow-cylindrical and has at one front end 2 a cover 3. The cover 3 is freely rotatable and is held rotatably in a cover carrier 4 via a central bearing journal 7. The cover carrier 4 for this purpose has a central bearing bore 6. The bearing bore 6 is formed by a central bearing collar 5, which is formed on the planar cover carrier 4.

At the circumference, the cover carrier 4 has a circumferential mounting flange 9, which is fixedly connected to the roller shell 1 by means of a cover fastening 18. The cover fastening 19 is formed in this exemplary embodiment by a plurality of screw means.

The bearing journal 7 is held rotatably within the bearing bore 6 by a plurality of rolling bearings 8.1 and 8.2, wherein a retaining ring 20 is arranged at an end of the bearing journal 7 formed internally of the roller shell 1.

A retaining flange 21 is formed integrally on the opposite end of the bearing journal 7 and extends substantially in a recess 22 in the cover carrier 4. The cover 3 is held at the retaining flange 21 via a cover fastening 19. The cover fastening 19 is formed in this exemplary embodiment by a plurality of screw means.

The cover 3 has an outer diameter that is greater than the outer diameter of the cover carrier 4, wherein the cover 3 has a circumferential protective collar 23, which extends until just before the front end 2 of the roller shell 1. The cover 3 thus protrudes at the front end 2 of the roller shell 1.

In FIG. 2 a further exemplary embodiment of a cover is schematically illustrated, showing how this is preferably used in the case of heated roller shells. The exemplary embodiment according to FIG. 2 is substantially identical to the exemplary embodiment according to FIG. 1, and therefore only the differences will be explained at this juncture, reference being made otherwise to the previous description.

In the exemplary embodiment of the roller illustrated in FIG. 2 the roller shell 1 is assigned a heating means 14 on the inside. In this respect, the roller shell can be heated to higher temperatures in the range above 100° C.

In order to prevent a heating of the cover 3 at the front end 2 of the roller shell 1, the cover 3 is formed in this exemplary embodiment by an outer cover 11 and an inner cover 10. The inner cover 10 and the outer cover 11 are screwed to one another, wherein the inner cover 10 has, on a front end face 16, a plurality of circumferential grooves 15. The grooves 15 are arranged concentrically with one another and are separated from one another by webs 24. The webs 24 here form a contact surface for a front end face 17 of the outer cover 11. In this respect, a plurality of air chambers 13 are formed within the cover 3. The air chambers 13 constitute a thermal insulation 12 that prevents the transfer of heat from the inner cover 10 to the outer cover 11. The contact surface between the inner cover 10 and the outer cover 11 is additionally considerably reduced, such that there is a direct transport of heat only via the webs 24.

In addition, the outer cover 11 is formed from a thermally insulating material, which has a very low thermal conductivity.

The inner cover 10 and the outer cover 11 are fixedly connected jointly via a retaining flange 21 to a bearing journal 7, which is mounted rotatably in a cover carrier 4. The design of the cover carrier 4 and of the bearing journal 7 is identical to the exemplary embodiment according to FIG. 1, and therefore reference can be made to the previous description.

In the case of the cover 3 illustrated in FIG. 2 the thermal insulation 12 formed by air chambers 13 is merely exemplary. In principle, the inner cover 10 by way of example may be formed from a thermally insulating material. It is essential here to guarantee the stability of the cover.

The exemplary embodiments according to FIGS. 1 and 2 constitute only possible design variants of a freely rotatable cover on the front end of a roller. It is essential here that the contact surface formed by the cover is held at the front end of the roller shell in a manner decoupled from the rotational movement of the roller shell. The embodiment of the bearing between the cover and the cover carrier is thus exemplary. The rolling bearing system can thus also be formed advantageously with just a needle bearing.

Alternatively, it is possible to use a plain bearing in order to be able to move the cover relative to the cover carrier.

Depending on the condition of the roller it is also possible to provide the cover carrier with a bearing journal and to provide the cover with a bearing bore.

The cover could also be mounted directly via a sliding disc in a recess of the cover carrier. It is essential to the invention that the outer cover at the front end face of the roller is decoupled from the rotational movement of the roller.

The invention claimed is:

1. Roller for guiding and treating synthetic strand materials, having a drivable roller shell, which is hollow-cylindrical and which has, on a projecting free front end thereof, a cover which shields the interior of the roller shell against surrounding environment influences, wherein the cover is connected to the roller shell in a freely rotatable manner, and wherein the roller is constructed and arranged to receive support on a supported end which is opposite the projecting free front end, and not receive support on the projecting free front end.

2. Roller as claimed in claim 1, wherein at the front end a cover carrier is provided between the roller shell and the cover, which cover carrier is fixedly connected to the roller shell and rotatably holds the cover.

3. Roller as claimed in claim 2, wherein the cover carrier has a central bearing bore, in which a bearing journal is rotatably held, and the cover is fixedly connected to the bearing journal.

4. Roller as claimed in claim 3, wherein the bearing journal is mounted in the cover carrier by one or more rolling bearings.

5. Roller as claimed in claim 4, wherein the roller further has a heating means disposed on the inside of the roller shell, and thermal insulation disposed on an inner side or outer side of the cover.

6. Roller as claimed in claim 4, wherein the cover is formed from an inner cover and an outer cover, wherein the inner cover and the outer cover encase a thermal insulation.

7. Roller as claimed in claim 6, wherein the thermal insulation is formed by a plurality of air chambers, wherein the air chambers are uniformly distributed within the cover.

8. Roller as claimed in claim 7, wherein the air chambers are formed by circumferential grooves on a front end face of the inner cover which front end face is opposite a closed front end face of the outer cover.

9. Roller as claimed in claim 8, wherein the outer cover is formed from a thermally insulating material.

10. Roller apparatus for guiding and treating synthetic strand materials, the roller apparatus comprising:

a drivable roller shell which defines a projecting free front end and a supported end which is opposite the projecting free front end, the roller shell being operative to receive support on the supported end and not receive support on the projecting free front end; and a cover which, with respect to a surrounding environment, covers at least a portion of the projecting free front end, wherein the cover connects to the roller shell in a freely rotatable manner.

11. Roller for guiding and treating synthetic strand materials, having a drivable roller shell, which is hollow-cylindrical and which has, on a projecting free front end thereof, a cover which shields the interior of the roller shell against surrounding environment influences, wherein the cover is connected to the roller shell in a freely rotatable manner, wherein at the front end a cover carrier is provided between the roller shell and the cover, which cover carrier is fixedly connected to the roller shell and rotatably holds the cover, wherein the cover carrier has a central bearing bore, in which a bearing journal is rotatably held, and the cover is fixedly connected to the bearing journal, wherein the bearing journal is mounted in the cover carrier by one or more rolling bearings, wherein the cover is formed from an inner cover and an outer cover, wherein the inner cover and the outer cover encase a thermal insulation, wherein the thermal insulation is formed by a plurality of air chambers, wherein the air chambers are uniformly distributed within the cover, and wherein the air chambers are formed by circumferential grooves on a front end face of the inner cover which front end face is opposite a closed front end face of the outer cover.

12. Roller as claimed in claim 11, wherein the outer cover is formed from a thermally insulating material.

* * * * *